US010655937B2

(12) United States Patent
Anderson

(10) Patent No.: US 10,655,937 B2
(45) Date of Patent: May 19, 2020

(54) SIGHT FOR FIREARM

(71) Applicant: Crimson Trace Corporation, Wilsonville, OR (US)

(72) Inventor: Danny Homem de Mello Anderson, Wilsonville, OR (US)

(73) Assignee: CRIMSON TRACE CORPORATION, Springfield, MA (US)

( * ) Notice: Subject to any disclaimer, the term of this patent is extended or adjusted under 35 U.S.C. 154(b) by 0 days.

(21) Appl. No.: 16/253,766

(22) Filed: Jan. 22, 2019

(65) Prior Publication Data

US 2019/0226809 A1 Jul. 25, 2019

Related U.S. Application Data

(60) Provisional application No. 62/620,382, filed on Jan. 22, 2018.

(51) Int. Cl.

| | |
|---|---|
| ***F41G 1/35*** | (2006.01) |
| ***F41G 11/00*** | (2006.01) |
| *F41G 1/387* | (2006.01) |

(52) U.S. Cl.

CPC ..... *F41G 11/003* (2013.01); *F41G 1/35* (2013.01); *F41G 11/004* (2013.01); *F41G 1/387* (2013.01)

(58) Field of Classification Search

CPC ... F41A 35/00; F41G 1/32; F41G 1/34; F41G 1/35; F41G 1/36; F41G 3/2616; F41G 3/2622; F41G 3/2644; F41G 3/2655

USPC ..... 42/111, 114, 115, 117, 132, 145

See application file for complete search history.

(56) References Cited

U.S. PATENT DOCUMENTS

| | | | | | |
|---|---|---|---|---|---|
| 2,844,710 | A * | 7/1958 | Zinsser | F41G 1/35 | 362/113 |
| 3,739,167 | A * | 6/1973 | Avery | F21L 14/00 | 362/157 |
| 3,914,873 | A * | 10/1975 | Elliott, Jr. | F41G 1/345 | 42/132 |
| 3,919,781 | A * | 11/1975 | Chaba | F41G 1/425 | 42/111 |
| 4,044,486 | A * | 8/1977 | Van Holten | F41G 11/003 | 42/127 |
| 4,161,076 | A * | 7/1979 | Snyder | F41G 11/002 | 362/113 |
| 4,233,770 | A * | 11/1980 | de Filippis | F41G 1/34 | 42/114 |
| 5,026,158 | A * | 6/1991 | Golubic | F41G 1/38 | 356/252 |
| 5,068,969 | A * | 12/1991 | Siebert | F41G 1/345 | 362/110 |

(Continued)

*Primary Examiner* — Derrick R Morgan

(74) *Attorney, Agent, or Firm* — Schwabe Williamson & Wyatt, P.C.

(57) ABSTRACT

A system, including a firearm comprising a receiver and an illumination sight. A illumination sight for a firearm that includes a housing member that is configured to be placed over a receiver of a firearm that couplable to a top portion of the receiver, the housing member including a lower extension that extends down the side of the receiver toward a trigger of the firearm when installed, a light source disposed within the housing member, and a power source disposed within the housing member that is configured to power the light source. A firearm that includes a laser sight illumination sight.

23 Claims, 18 Drawing Sheets

(56) References Cited

U.S. PATENT DOCUMENTS 5,142,806 A * 9/1992 Swan ..... F41C 33/08 42/114
5,194,007 A * 3/1993 Marshall ..... F41A 33/02 42/114
5,299,375 A * 4/1994 Thummel ..... F41G 1/35 362/110
5,369,888 A * 12/1994 Kay ..... F41G 1/30 356/252
5,483,362 A * 1/1996 Tai ..... F41G 1/30 359/1
5,671,561 A * 9/1997 Johnson ..... F41G 1/35 42/114
5,735,070 A * 4/1998 Vasquez ..... F41A 9/62 42/1.02
5,815,936 A * 10/1998 Sieczka ..... G03H 1/0005 42/115
5,822,905 A * 10/1998 Teetzel ..... F41C 23/16 42/117
5,913,669 A * 6/1999 Hansen ..... F41G 1/36 362/110
6,363,648 B1 * 4/2002 Kranich ..... F41G 1/35 42/114
6,671,991 B1 * 1/2004 Danielson ..... F41C 23/00 42/114
6,863,532 B1 * 3/2005 Ambrosoli ..... F41G 3/2655 434/11
7,069,685 B2 * 7/2006 Houde-Walter ..... F41C 27/00 42/113
7,145,703 B2 * 12/2006 Sieczka ..... F41G 1/30 359/15
7,472,830 B2 * 1/2009 Danielson ..... F41G 1/35 235/404
8,093,992 B2 * 1/2012 Jancic ..... F41G 1/35 340/12.5
8,240,077 B2 * 8/2012 Holmberg ..... F41G 11/003 42/114
8,397,418 B2 * 3/2013 Cabahug ..... F41C 23/22 42/85
9,212,867 B2 * 12/2015 Patterson ..... F41G 1/345
9,891,023 B2 * 2/2018 Compton ..... F41G 11/003
10,408,570 B2 * 9/2019 Toole ..... F41G 1/35
2002/0166278 A1 * 11/2002 Carlson ..... F41G 1/345 42/132
2002/0194767 A1 * 12/2002 Houde-Walter ..... F41G 1/35 42/114
2004/0031184 A1 * 2/2004 Hope ..... F41C 27/00 42/111
2006/0163359 A1 * 7/2006 Danielson ..... F41G 1/35 235/472.01
2007/0287134 A1 * 12/2007 Chung ..... F41A 33/02 434/22
2008/0092423 A1 * 4/2008 Keng ..... F41G 1/02 42/111
2010/0218410 A1 * 9/2010 Cabahug ..... F41C 27/00 42/71.01
2010/0229448 A1 * 9/2010 Houde-Walter ..... F41C 23/16 42/72
2011/0283585 A1 * 11/2011 Cabahug ..... F41C 23/22 42/73
2012/0047787 A1 * 3/2012 Curry ..... F41G 1/35 42/115
2012/0224357 A1 * 9/2012 Moore ..... F41G 1/35 362/110
2012/0311912 A1 * 12/2012 Howe ..... F41G 1/01 42/111
2013/0047482 A1 * 2/2013 Mulfinger ..... F41C 27/00 42/84
2015/0020427 A1 * 1/2015 Compton ..... F41C 27/00 42/71.01
2016/0091281 A1 * 3/2016 Gwillim, Jr. ..... F41G 1/345 42/111
2016/0209169 A1 * 7/2016 Toole ..... F41G 1/35
2017/0343319 A1 * 11/2017 Galli ..... F41G 11/003
2019/0049221 A1 * 2/2019 Zimmer ..... F41G 11/003
2019/0226804 A1 * 7/2019 Toole ..... F41G 1/35
2019/0323795 A1 * 10/2019 Zimmer ..... F41C 23/12

* cited by examiner

SIGHT FOR FIREARM

CROSS-REFERENCE TO RELATED APPLICATION

This application claims the priority benefit of the earlier filing date of U.S. Provisional Application No. 62/620,382, filed Jan. 22, 2018, which is hereby incorporated herein by reference in its entirety.

TECHNICAL FIELD

Embodiments relate to illumination sights for firearms, and in particular, illumination sights that fit to the receiver of firearms.

BACKGROUND

Lasers are used in many firearms applications as tools to enhance targeting. For example, one form of firearm sight makes use of a laser placed on a handgun or a rifle and aligned to emit a beam parallel to the barrel. Since a laser beam by definition has low divergence, the laser light appears as a small spot even at long distances. The user places the spot on the desired target and the barrel of the gun is aligned. Most laser sights use a red or green laser diode. Others use an infrared (IR) diode to produce a dot invisible to the naked human eye but detectable with night vision devices.

Lighting devices also be used with firearms in order to illuminate the field or stun the target. Such lighting devices include visible (e.g., white) lights and/or infrared lights, for instance for use in low lighting conditions with night vision goggles. However, laser sights and illumination devices can be bulky and awkward to use, and can render the firearm incompatible with a holster. They can also be difficult to mount on the firearm, and can be expensive. Non-shoulderable firearms, such as the Mossberg Shockwave and the Remington Tac-14 have a pistol grip, are at least 26 inches long, and typically are fired from hip or torso-height. Thus, sighting with a standard iron sight is difficult or impossible. Grip stability is particularly important when using firearms, including non-shoulderable firearms.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
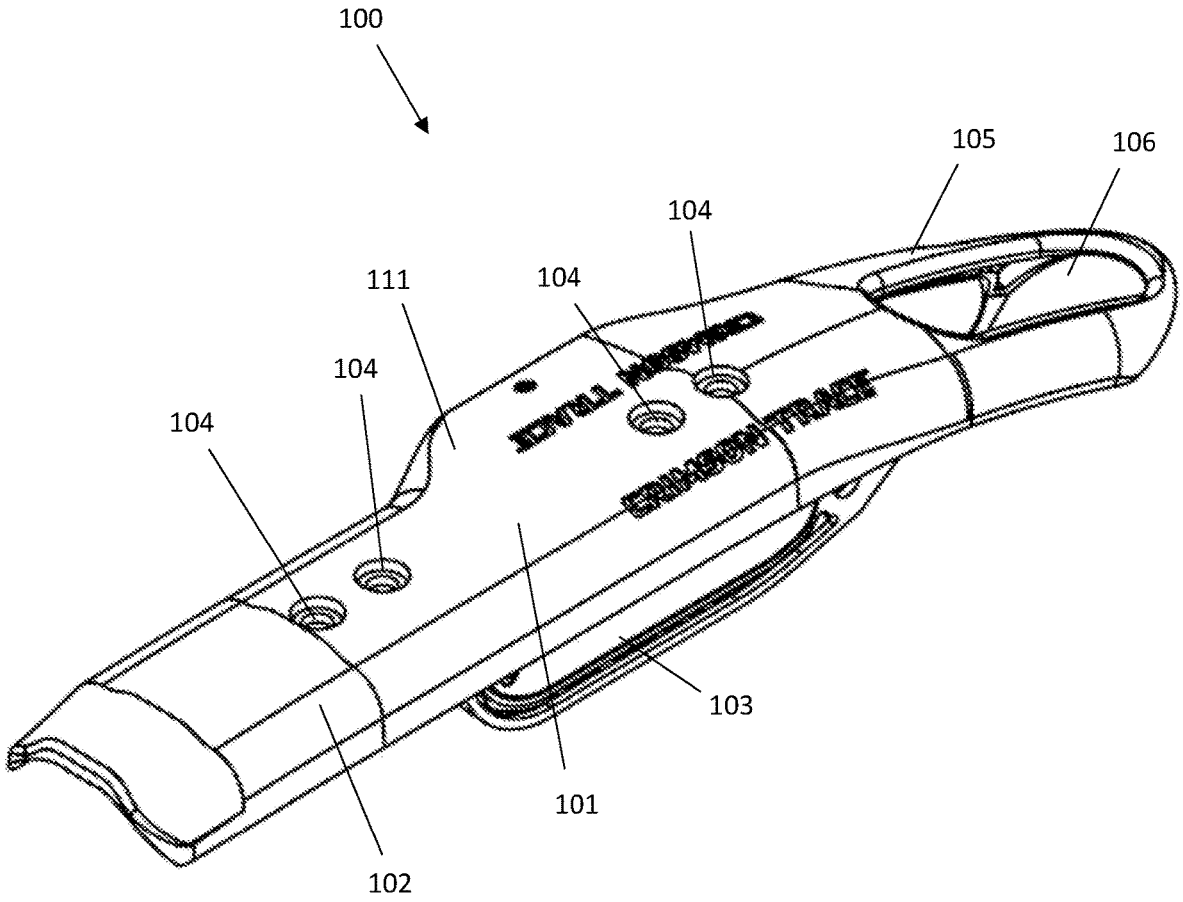
FIG. 1 illustrates a top front perspective view of an illumination sight for a firearm, in accordance with various embodiments.
Figure 2:
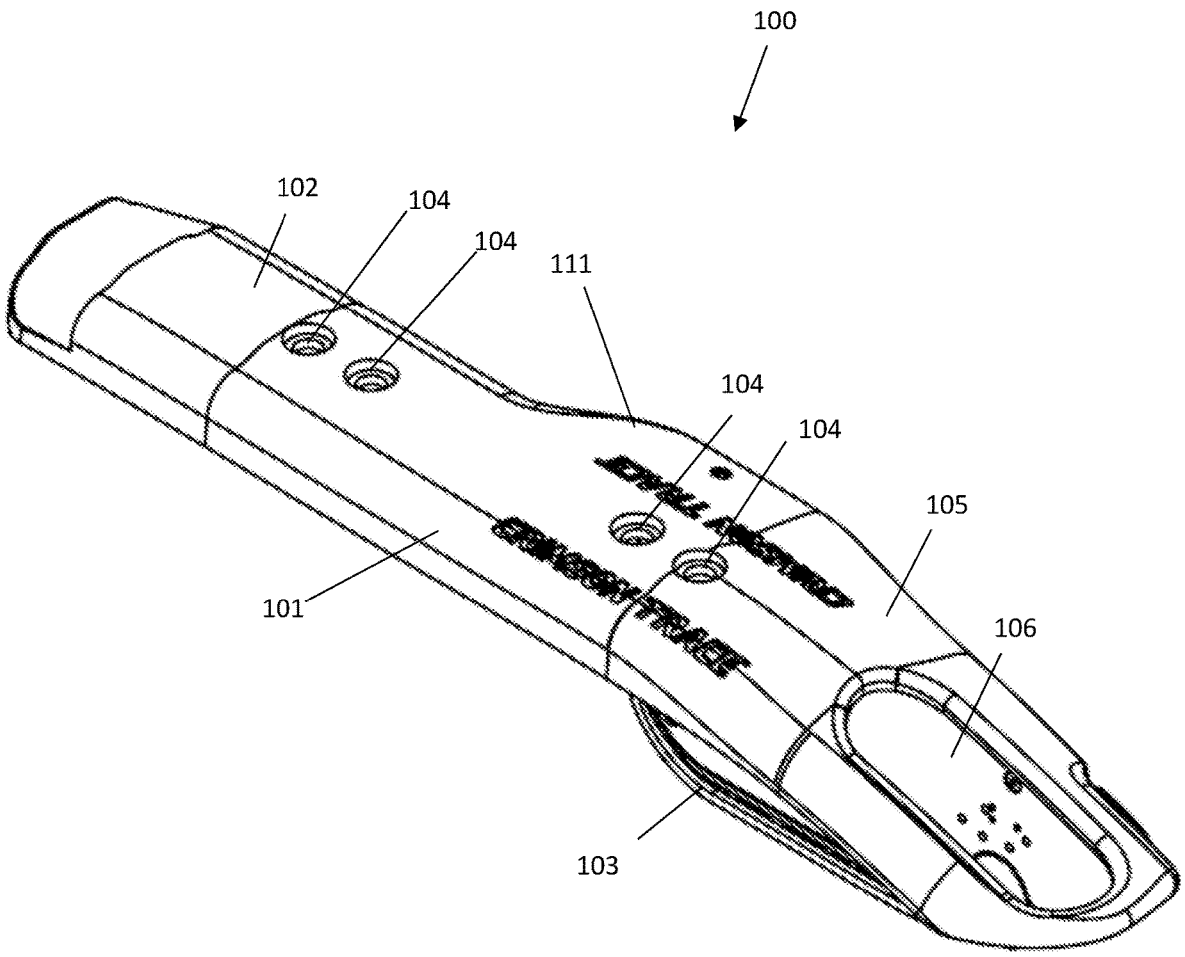
FIG. 2 illustrates a top rear perspective view of the illumination sight for a firearm shown in FIG. 1, in accordance with various embodiments.
Figure 3:
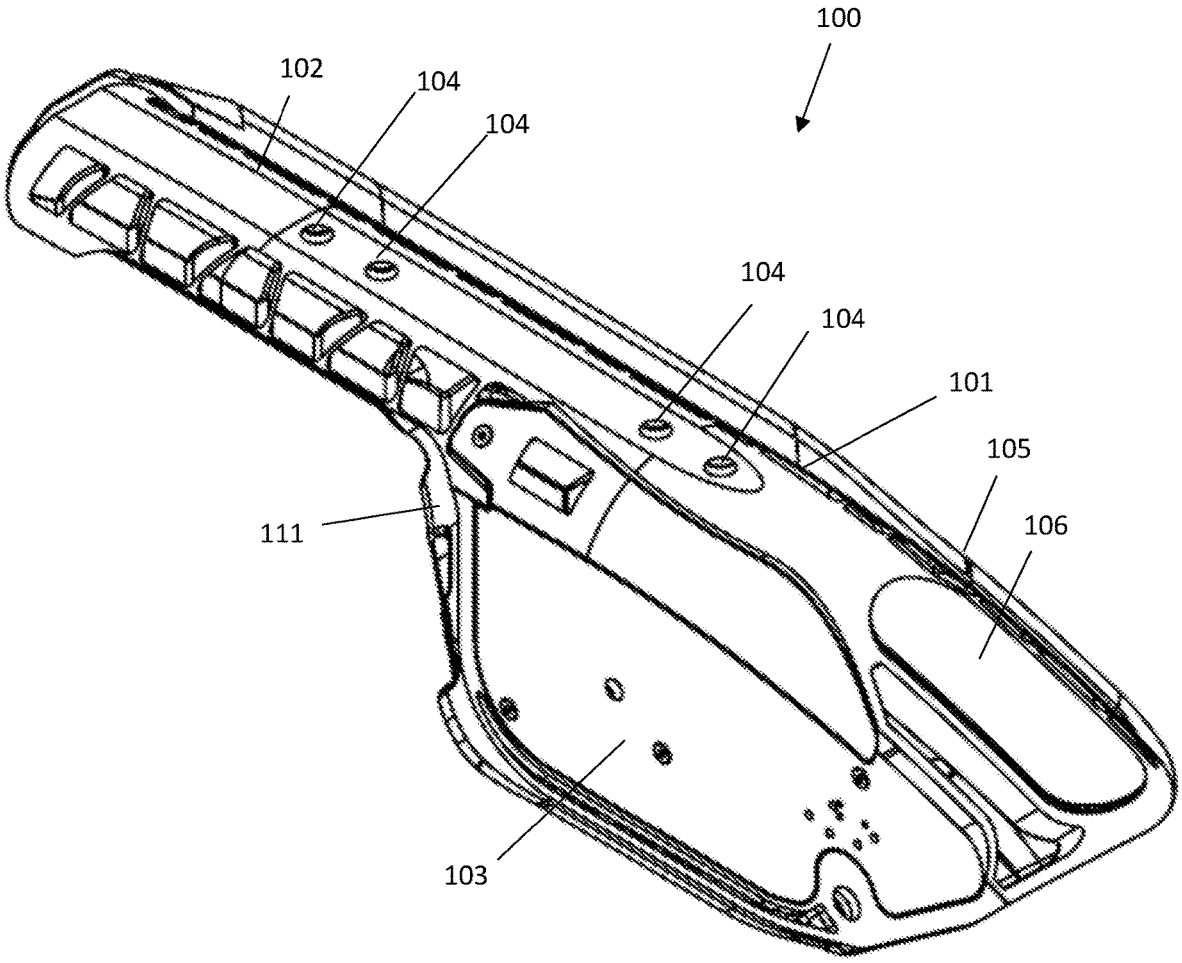
FIG. 3 illustrates a bottom front perspective view of the illumination sight for a firearm shown in FIG. 1, in accordance with various embodiments.
Figure 4:
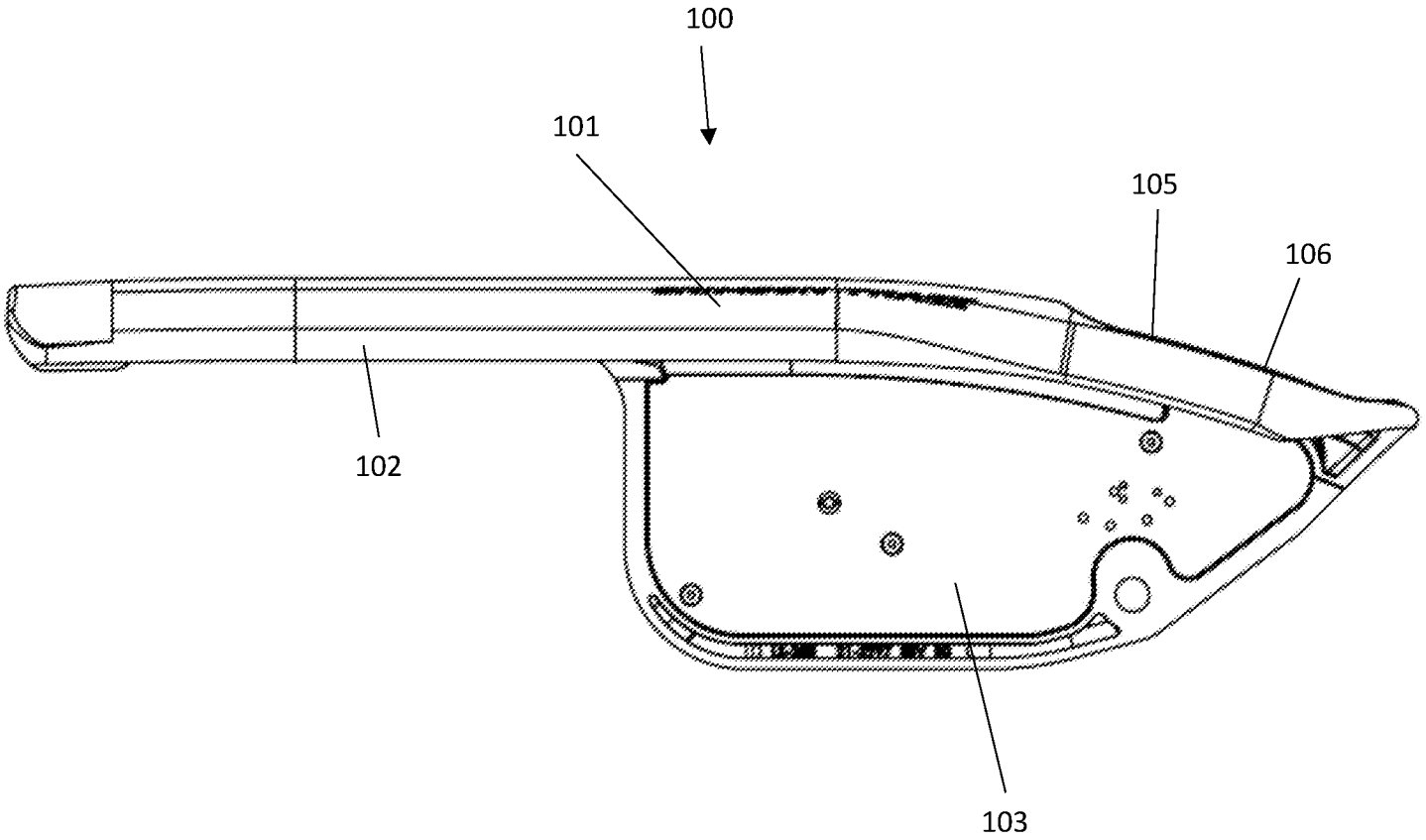
FIG. 4 illustrates a side elevation view of the illumination sight for a firearm shown in FIG. 1, in accordance with various embodiments.
Figure 5:
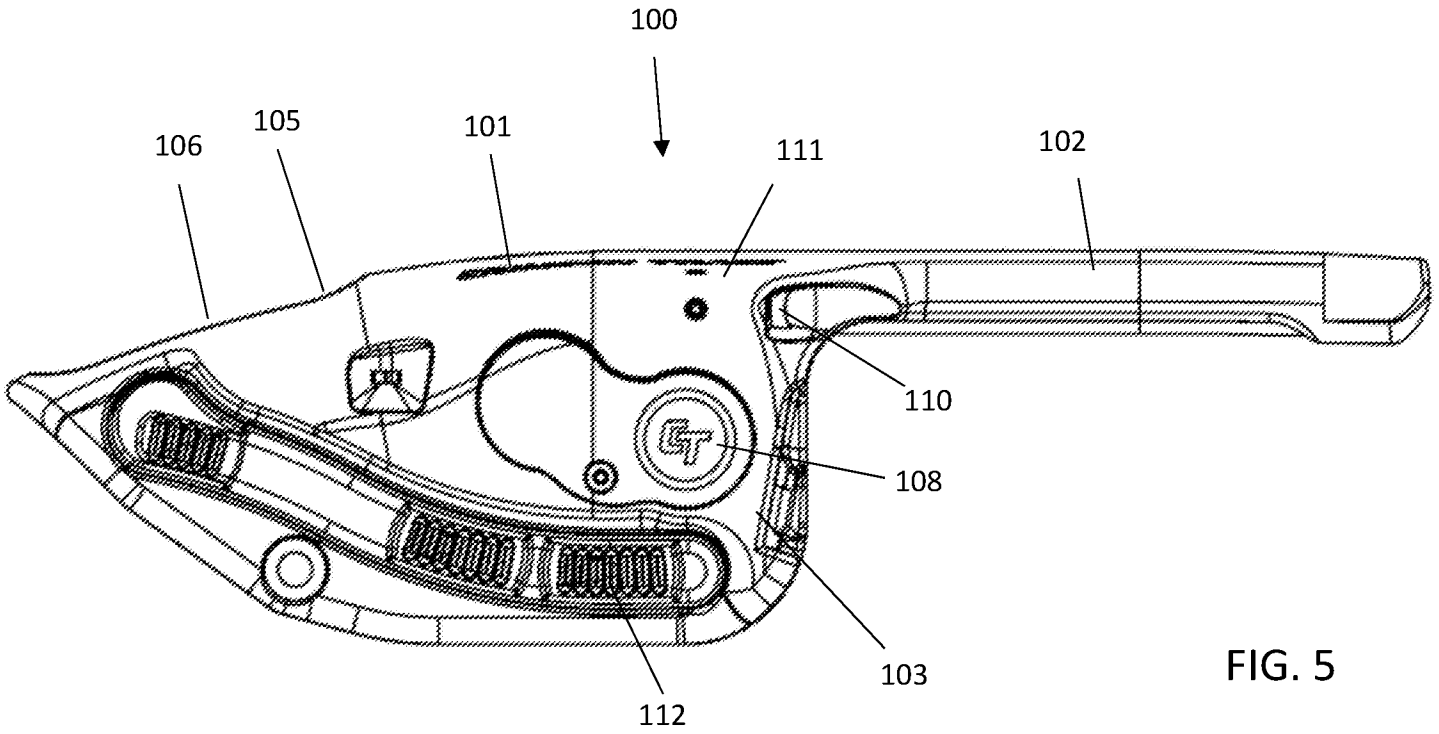
FIG. 5 illustrates a side elevation view of the illumination sight for a firearm shown in FIG. 1, in accordance with various embodiments.
Figure 6:
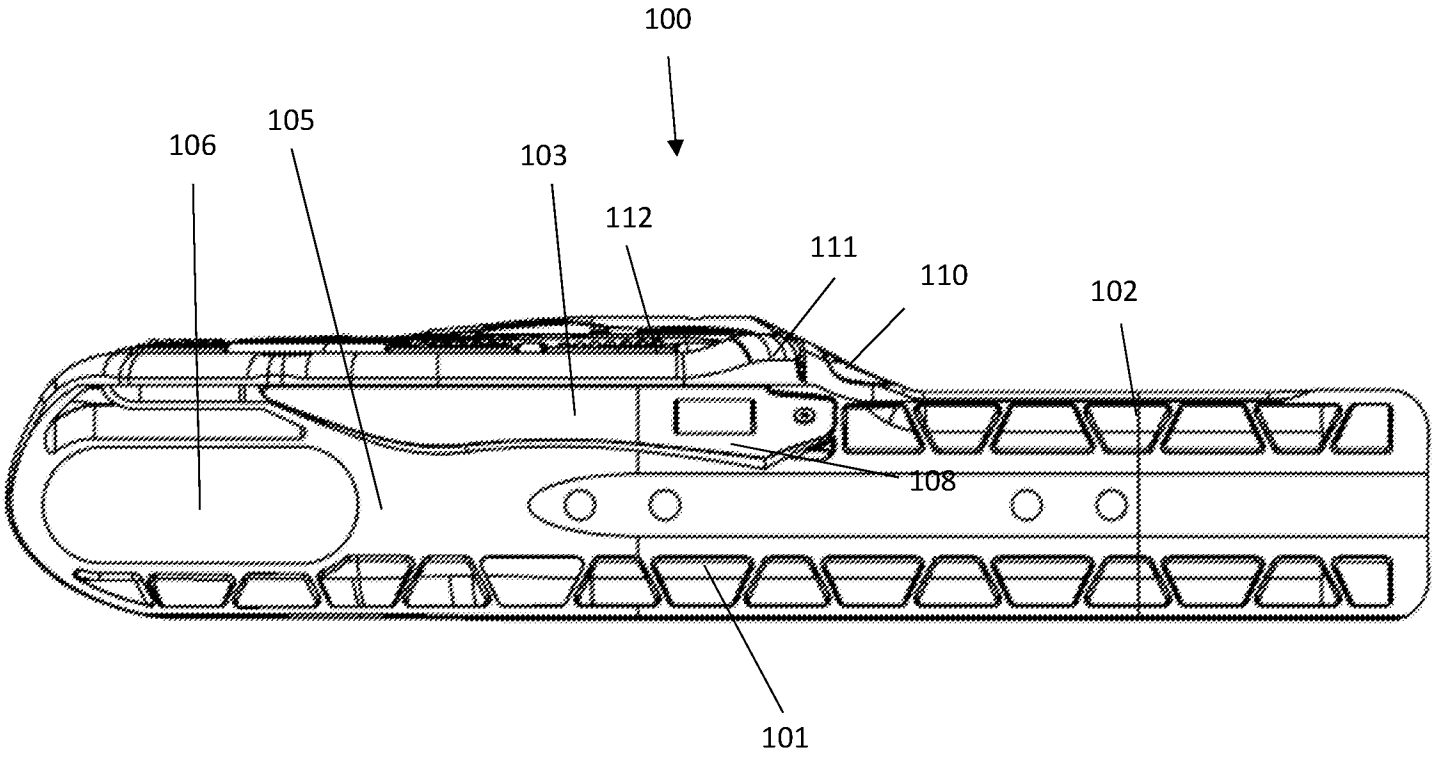
FIG. 6 illustrates a bottom view of the illumination sight for a firearm shown in FIG. 1, in accordance with various embodiments.
Figure 7:
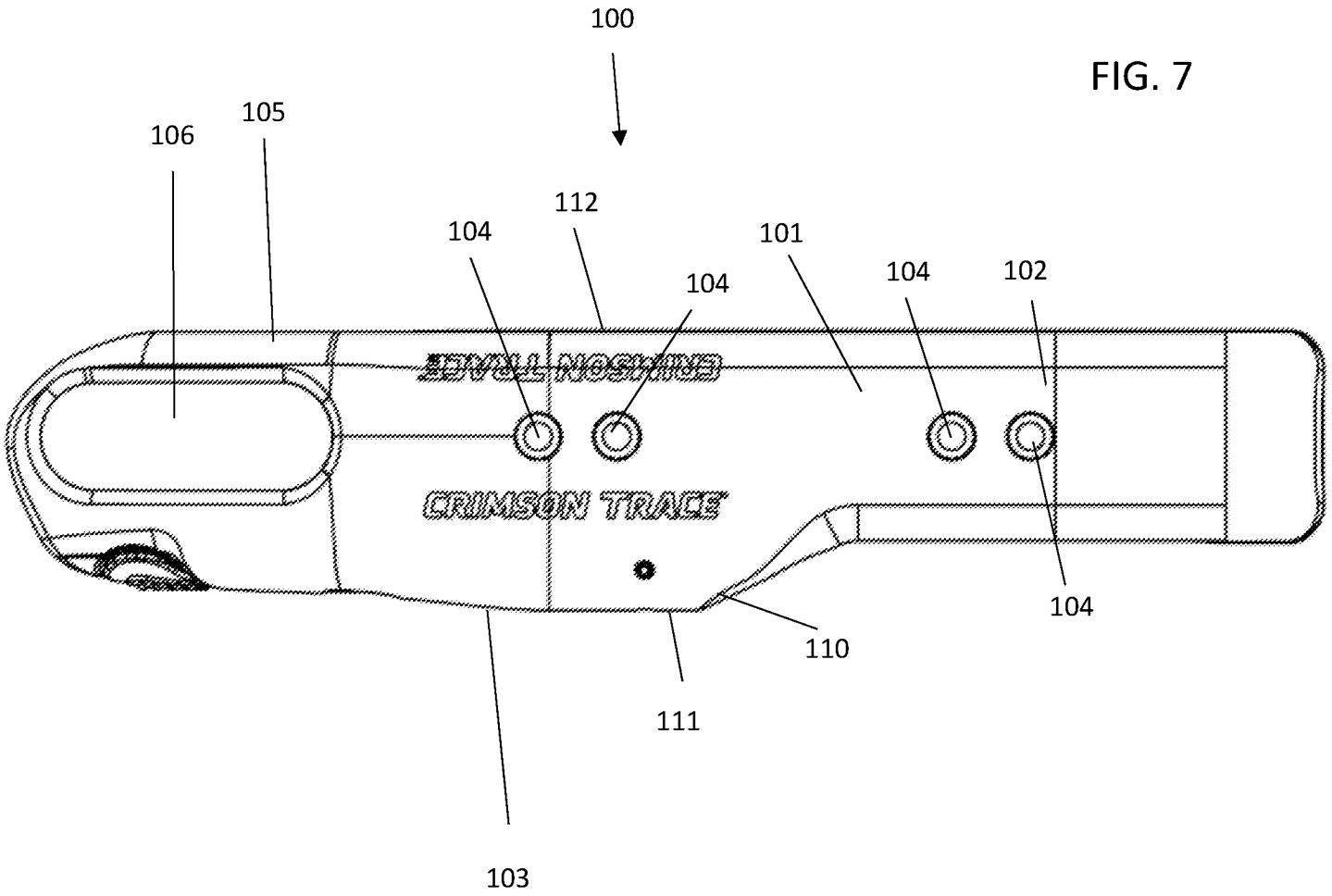
FIG. 7 illustrates a top view of the illumination sight for a firearm shown in FIG. 1, in accordance with various embodiments.
Figure 8:
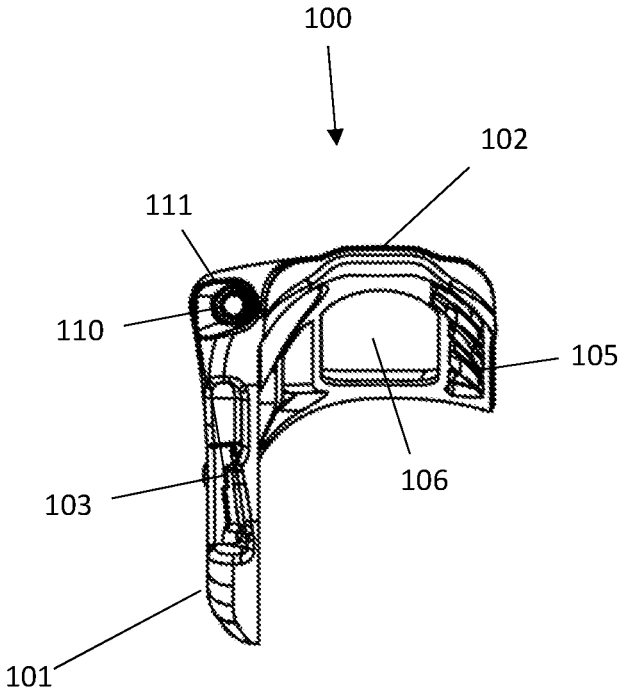
FIG. 8 illustrates a front view of the illumination sight for a firearm shown in FIG. 1, in accordance with various embodiments.
Figure 9:
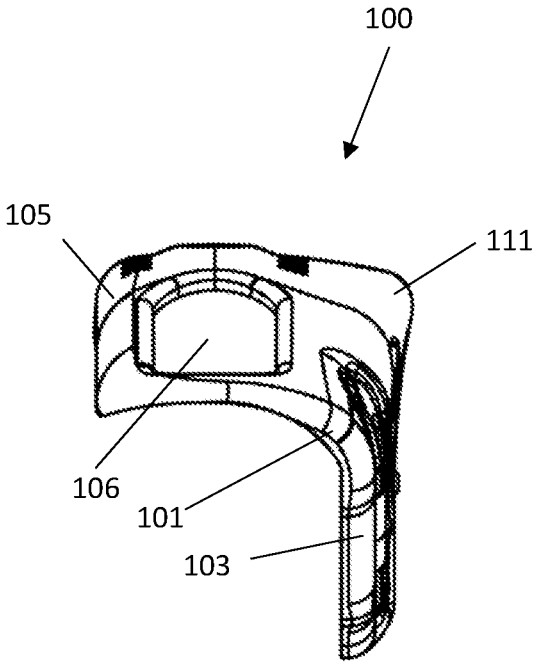
FIG. 9 illustrates a rear view of the illumination sight for a firearm shown in FIG. 1, in accordance with various embodiments.

In the following detailed description, reference is made to the accompanying drawings which form a part hereof, and in which are shown by way of illustration embodiments that be practiced. It is to be understood that other embodiments be utilized and structural or logical changes be made without departing from the scope. Therefore, the following detailed description is not to be taken in a limiting sense, and the scope of embodiments is defined by the appended claims and their equivalents.

Various operations be described as multiple discrete operations in turn, in a manner that be helpful in understanding embodiments; however, the order of description should not be construed to imply that these operations are order dependent.

The description use perspective-based descriptions such as up/down, back/front, and top/bottom. Such descriptions are merely used to facilitate the discussion and are not intended to restrict the application of disclosed embodiments.

The terms "coupled" and "connected," along with their derivatives, be used. It should be understood that these terms are not intended as synonyms for each other. Rather, in particular embodiments, "connected" be used to indicate that two or more elements are in direct physical or electrical contact with each other. "Coupled" mean that two or more elements are in direct physical or electrical contact. However, "coupled" also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description use the terms "embodiment" or "embodiments," which each refer to one or more of the same or different embodiments. Furthermore, the terms "comprising," "including," "having," and the like, as used with respect to embodiments, are synonymous.

DESCRIPTION OF SEVERAL EMBODIMENTS

Embodiments herein provide illumination sights and/or illumination sources and systems that include illumination sights, such as red or green laser sights, and/or illumination lights, for use with firearms, such as non-shoulderable shotguns, which include firearms that are legally classified as firearms or pump action pistols. Such non-shoulderable shotguns typically have a barrel of about 14 inches in length, and they include a pistol grip in place of a stock. Because these firearms lack a stock, they typically are fired from hip or torso height, making it difficult or impossible to sight the firearm with a standard iron sight. Specific, non-limiting examples of non-shoulderable shotguns include the Mossberg Shockwave and the Remington Tac-14. In various embodiments, the systems, sights and device disclosed herein may be used with any firearm, including any non-shoulderable firearm platform, and are not specific to any particular make or model of firearm or non-shoulderable firearms. In some examples, a firearm is a shotgun having a barrel less than 18 inches in length. In some examples, a firearm is a shotgun having a barrel about 14 inches in length. In some examples, a firearm is a weapon or device capable of being concealed on the person from which a shot can be discharged through the energy of an explosive, a pistol or revolver having a smooth bore designed or redesigned to fire a fixed shotgun shell, weapons with combination shotgun and rifle barrels 12 inches or more, less than 18 inches in length, from which only a single discharge can be made from either barrel without manual reloading, and shall include any such weapon which may be readily restored to fire. Such term shall not include a pistol or revolver having a rifled bore, or rifled bores, or weapons designed, made, or intended to be fired from the shoulder and not capable of firing fixed ammunition. In some examples, a firearm utilizes a shotgun-type receiver that has never had a shoulder stock attached. In some examples, a firearm includes a "bird's head" grip in lieu of a shoulder stock. In some examples, a firearm is pump action. In some examples, a firearm is semi-automatic. In some examples, a firearm exceeds 26 inches in length, such as 26 inches, 26½ inches or 27 inches.

Illumination sights, such as laser sights, provide aiming functionality even when a sight cannot be aligned with a user's eye. Thus, provided in various embodiments are Illumination sights, such as laser sights, that couple to an upper portion of a receiver of a firearm, such as a shotgun, for example, a non-shoulderable shotgun. In various embodiments, the disclosed Illumination sights project a laser beam, such as a red or a green laser, onto a target to facilitate aiming of the firearm. In various embodiments, the Illumination sight includes an illumination source that be aligned to project a beam that is substantially parallel to the barrel, and that intersects at a desired distance with the trajectory of a projectile (such as a bullet) fired from the firearm. In some embodiments, the Illumination sight produces a laser beam that produces a larger diameter laser sighting 'dot' compared to conventional laser sights for other types of firearms, such as a "dot" having a diameter of about two inches or greater at a distance of 1 meter. In use, the Illumination sight projects a laser beam onto a target to indicate the position where a projectile will land on the target when the firearm is actuated. In some embodiments, the Illumination sight be factory calibrated, and in other embodiments, the laser sight include windage and elevation screws to allow user calibration of the illumination beam with respect to a target.

Aspects of the present disclosure concern a firearm system that includes a firearm and an illumination sight that is couplable to the receiver of the firearm. In embodiments, the illumination sight includes a housing member that is configured to be placed over the top of a receiver of a firearm and reversibly couple to a top portion, for example the top surface, of the receiver. The housing member is configured and/or is shaped to fit closely against an outside surface of a receiver portion of a firearm. The illumination sight is mounted to the receiver portion of the firearm without the need of a rail and or adaptor. In various embodiments, the housing member protrudes less than ½ inch from the existing surfaces of the weapon when installed and is free of protruding edges that would prevent it from sliding in a scabbard. The resulting configuration results in a low-profile exterior surface that minimizes the chance of snagging on objects or undesirably affecting the usability of the firearm. The illumination sight is place over the receiver of the firearm. The sight has an attachment pin that replaces the firearm's original trigger housing pin. Once this provide pin is installed it partially secures the sight to the firearm. Additionally provided fasteners secures the sight to the firearm. In various embodiments, the system further comprises an attachment pin that replaces a trigger housing pin of the firearm when installed. In various embodiments, the system further comprises an adjustment tool stored within that is configured to adjust the sight and a battery compartment fastener. In various embodiments, the firearm is a non-shoulderable shotgun. In various embodiments, the illumination sight is configured to allow for mounting of a Picatinny rail on top of illumination sight and/or the barrel of the firearm.

In embodiments, the housing member includes a front portion that extends forward on the receiver towards the barrel of the firearm. The front portion is configured to follow the contour of the receiver as it moves toward the front of the firearm, and may include one or more or more fastener holes that align with one or more factory-provided fastener holes on the receiver, such that the front portion of the housing member can be coupled to the receiver with one or more screws or other fasteners. In embodiments, the front portion of the housing extends along the top of the receiver and above the ejection port of the firearm. By extending the front portion the housing member and hence the laser sight is more easily aligned axially with the barrel of the firearm.

In embodiments, the housing member includes a rear portion that extends rearward on the receiver towards the butt end of the fire arm. The rear portion is configured to follow the contour of the receiver as it moves toward away from front of the firearm, sloping downward toward the butt end of the firearm, and may include one or more or more fastener holes that align with one or more factory-provided fastener holes on the receiver, such that the rear portion of the housing member can be coupled to the receiver with one or more screws or other fasteners. In various embodiments, the housing member also includes one or more apertures in the rear portion to accommodate a safety switch or other feature of the receiver.

In embodiments, the housing member includes a lower extension that extends down the side of the receiver toward a trigger of the firearm when installed. The lower extension that is configured to follow the side contour of the receiver as it extends from the top of the receiver toward the bottom of the receiver, e.g., toward the trigger or trigger guard. The lower extension may include one or more gripping elements to allow the housing member to grip and couple to the receiver. The lower extension further includes the housing for the light source, such as a laser. The lower extension may also include a battery receptacle for housing one or more batteries to power the laser sight.

In embodiments, the illumination sight a light source disposed within the housing member, and a power source disposed within the housing member that is configured to power the light source. Some embodiments of the systems provide lighting, for instance visible (e.g., white) light for illuminating a field of use with visible light, and/or infrared (IR) light for use in low light or dark environments, for instance with a night vision device such as night vision goggles. Also provided in various embodiments are aiming and/or sighting systems, for instance which are equipped with an IR sight or a laser sight, such as a red or green laser. In various embodiments, the light source comprises a visible light laser diode, an infrared laser diode, an LED, an infrared light source, or a combination thereof.

In various embodiments, the illumination sight couples to the receiver in such a way as to provide a smooth, integrated-appearing profile. In various embodiments, such an unobtrusive profile be particularly suited for use with non-shoulderable shotguns due to the nature of the firearm. In various embodiments, the illumination sights described herein may further include a power source, such as a battery, an activation switch, and control circuitry, all of which be adapted to provide power to and control operation of the light source. In various embodiments, the illumination sight also includes one or more activation elements, such as switches. In some embodiments, an activation element or pair of elements be provided so that the user activate the laser sight with either hand without altering their grip on the firearm (e.g., the activation buttons, switches, pressure activation elements, and/or sensory technology elements be suitable for ambidextrous activation). In various embodiments, the activation switch is positioned within 4 inches, such as 1 to 4 inches, 2 to 4 inches, 3 to 4 inches, of a trigger of the firearm when installed on the firearm, such as a non-shoulderable shotgun. In some embodiments, being able to activate the device without altering grip be desirable, particularly because non-shoulderable shotguns require skilled handling in order to manage recoil. In embodiments, the illumination sight also includes a master switch for powering the device on or off.

Aspects of this disclosure concern an illumination sight for a firearm, such as described above with respect to the system. In embodiments, the illumination sight includes a housing member that is configured to be placed over a receiver of a firearm that is couplable to a top portion of a receiver of a firearm, the housing member including a lower extension that extends down the side of the receiver toward a trigger of the firearm when installed. The illumination sight includes a light source disposed within the housing member and a power source disposed within the housing member that is configured to power the light source.

Aspects of this disclosure concern a firearm that includes a laser sight as disclosed herein. In various embodiments, the firearm is a shotgun having a pistol grip.

Figure 11:
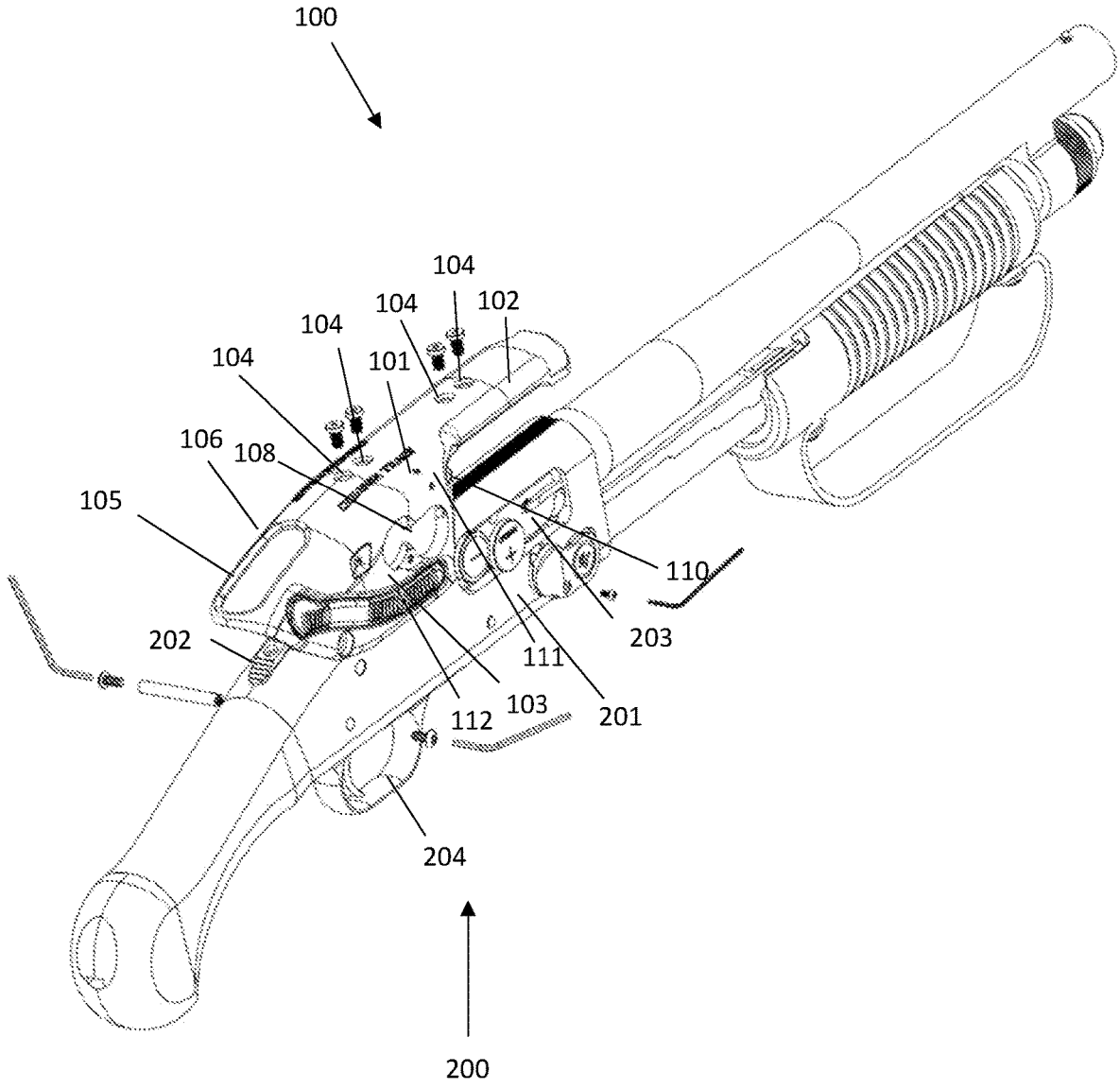
FIG. 11 illustrates an exploded top rear perspective view of the illumination sight for a firearm shown in FIG. 1, mounted on a non-shoulderable firearm, in accordance with various embodiments.
Figure 12:
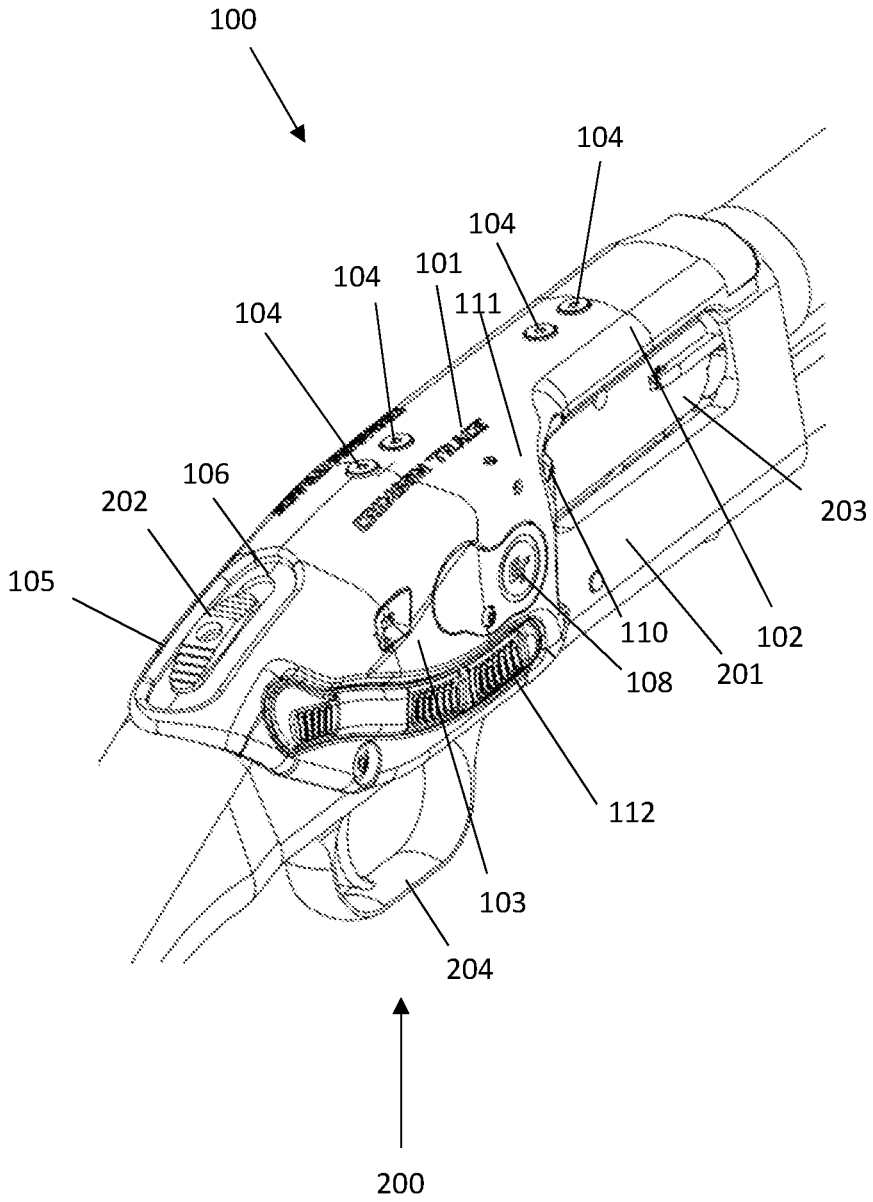
FIG. 12 illustrates a top rear perspective view of the illumination sight for a firearm shown in FIG. 1, mounted on a non-shoulderable firearm, in accordance with various embodiments.
Figure 13:
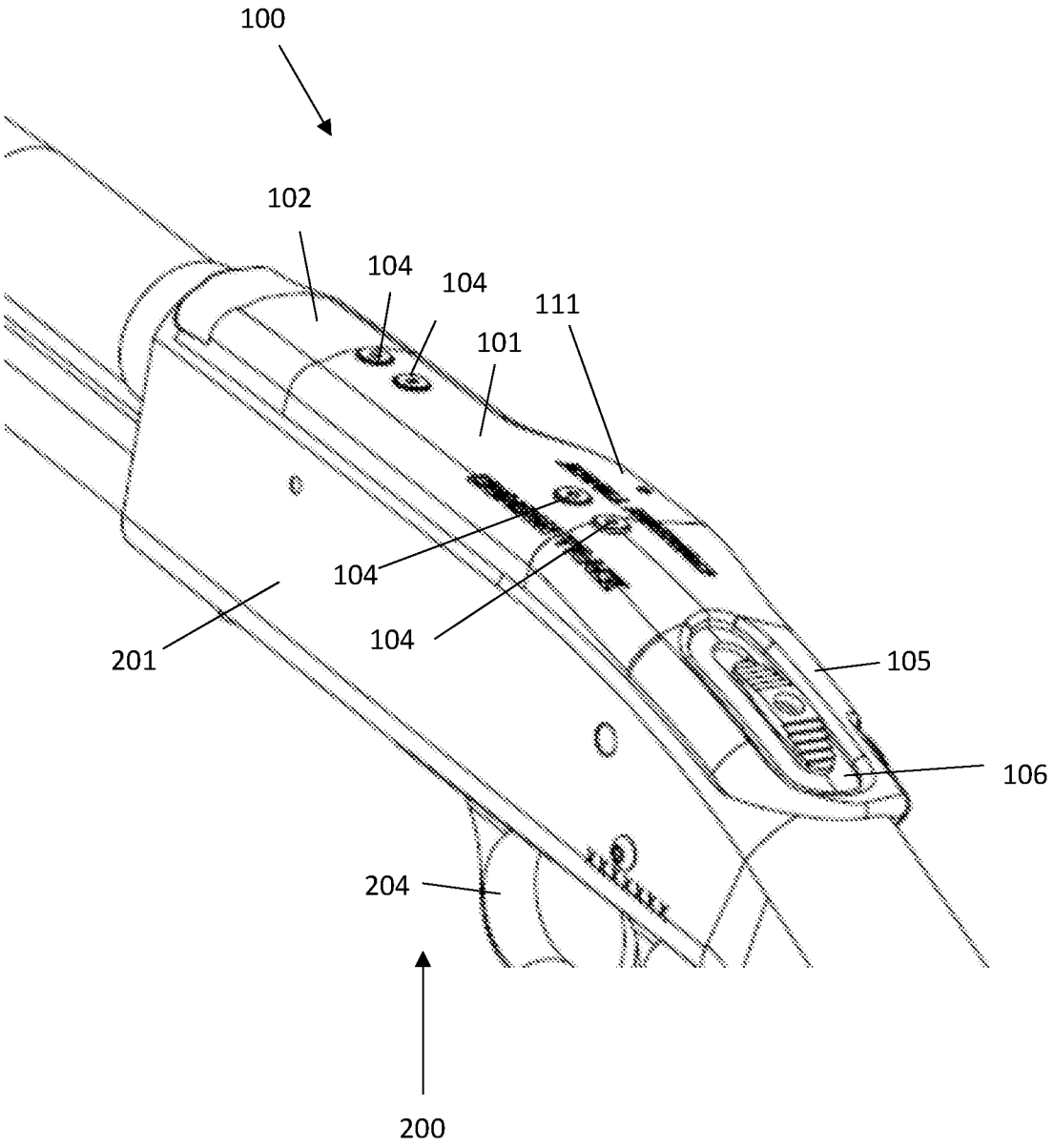
FIG. 13 illustrates a top rear perspective view of the illumination sight for a firearm shown in FIG. 1, mounted on a non-shoulderable firearm, in accordance with various embodiments.
Figure 14:
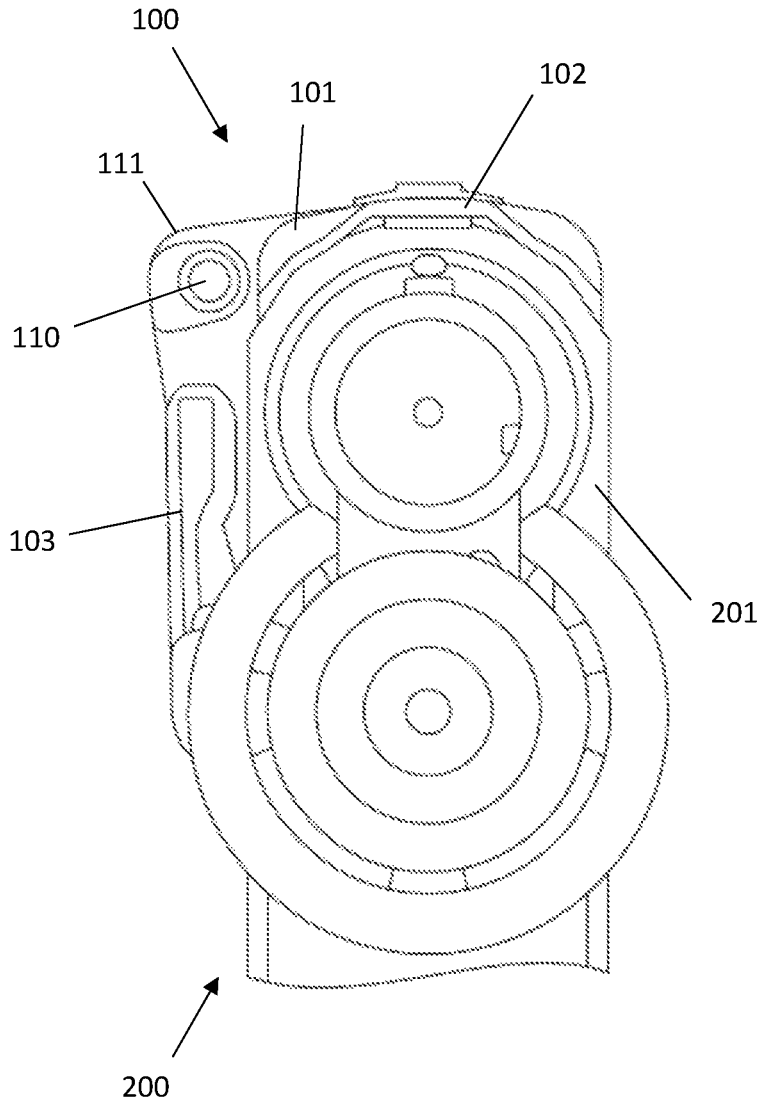
FIG. 14 illustrates a front view of the illumination sight shown in FIG. 1, mounted on a firearm, in accordance with various embodiments.
Figure 15:
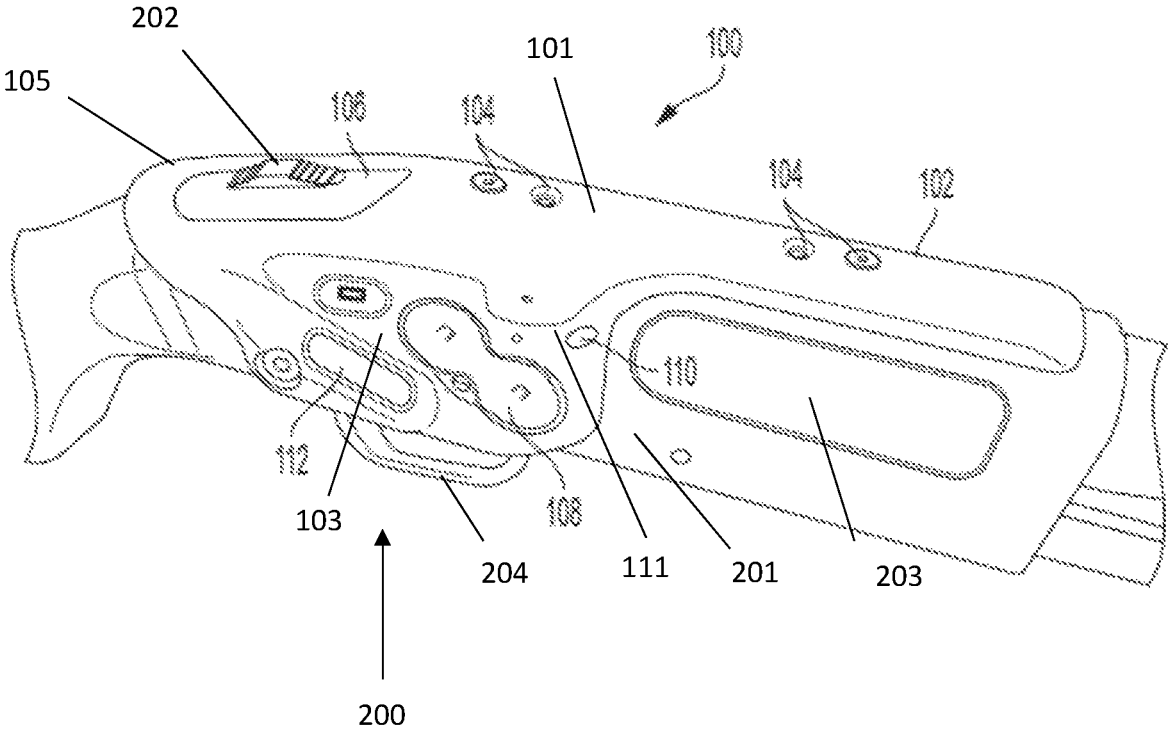
FIG. 15 illustrates a top front perspective view of an illumination sight for a firearm, mounted to a dummy model of a non-shoulderable firearm, in accordance with various embodiments.
Figure 16:
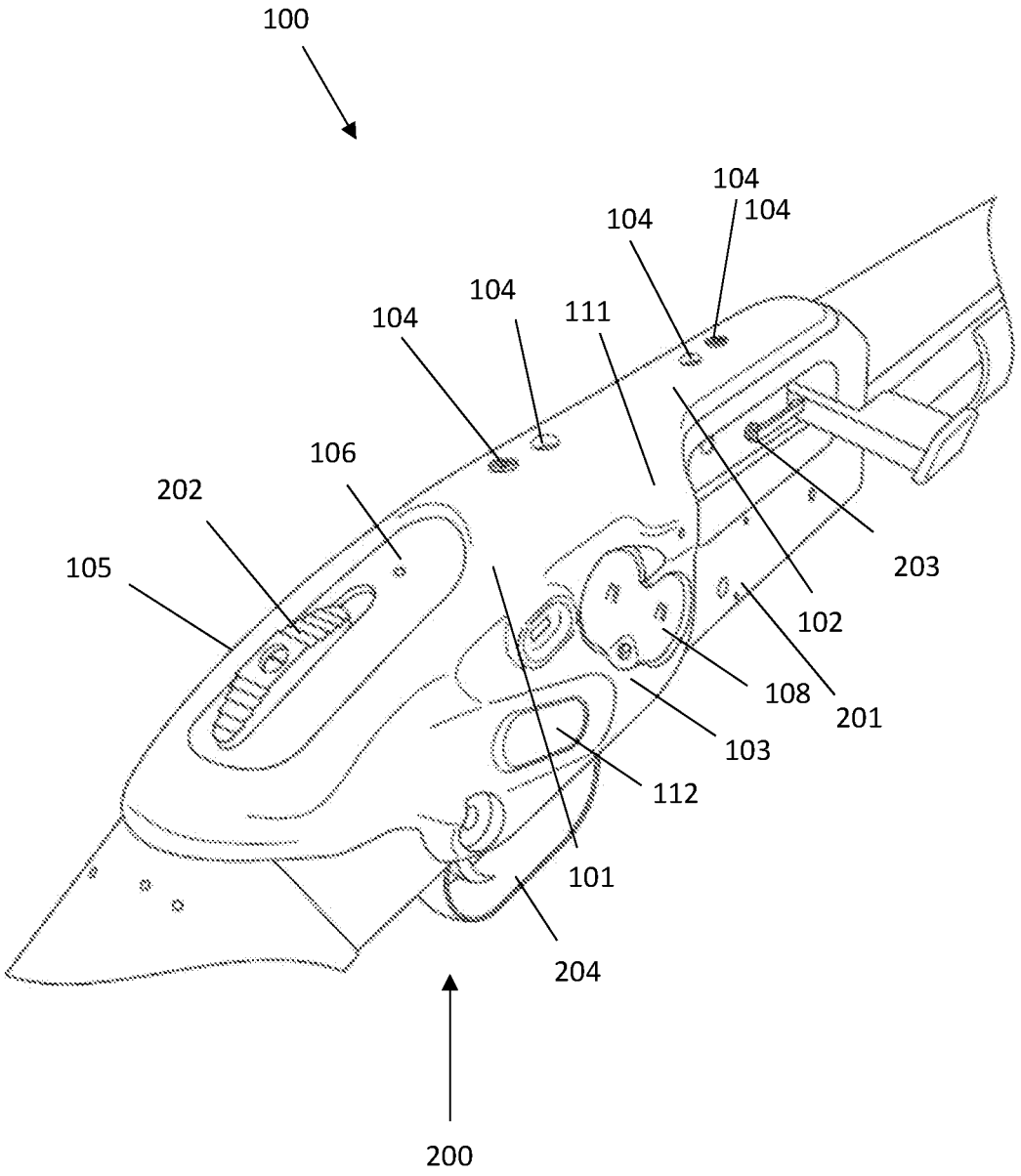
FIG. 16 illustrates a top rear perspective view of the illumination sight shown in FIG. 15, mounted on a non-shoulderable firearm, in accordance with various embodiments.
Figure 17:
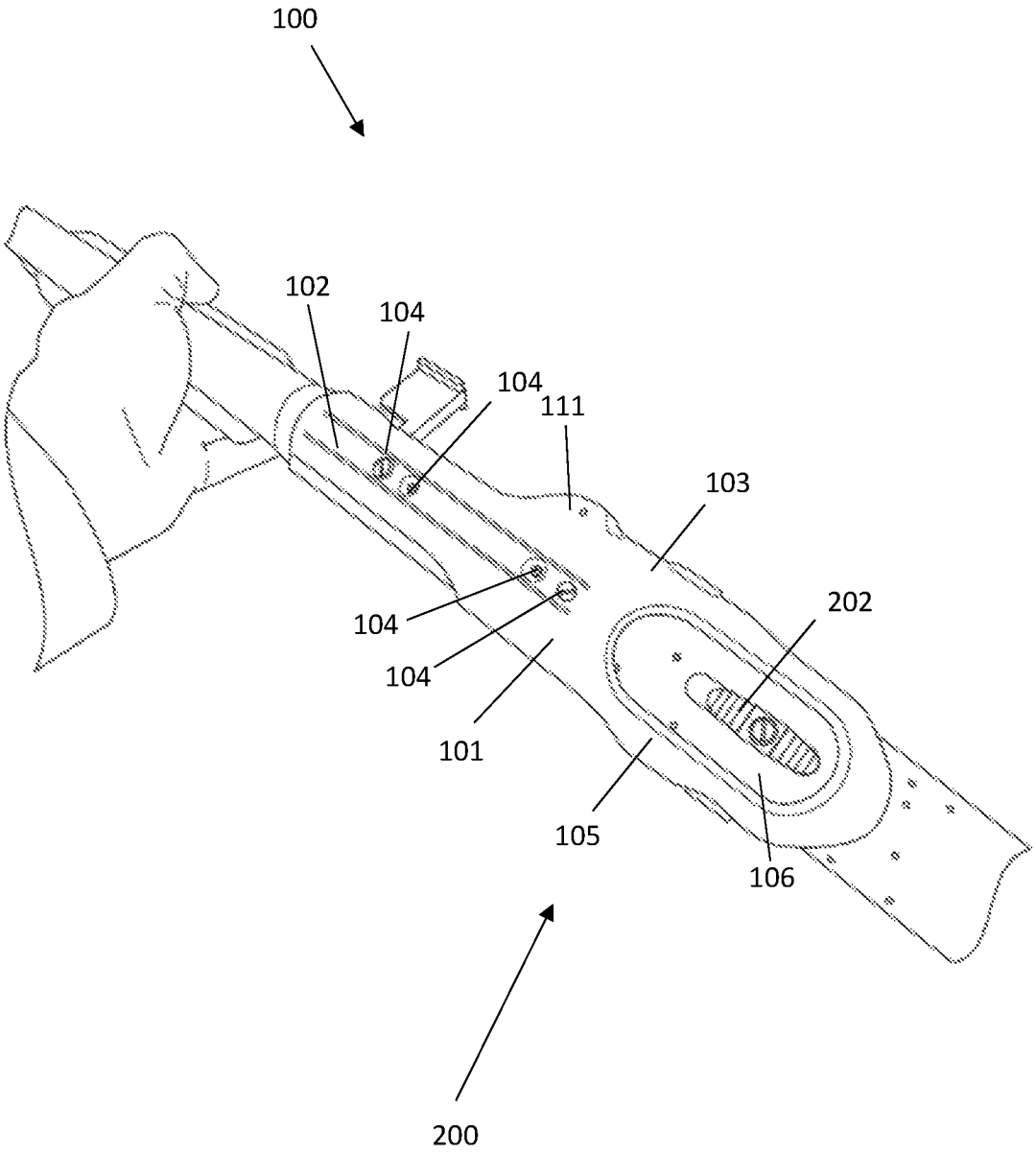
FIG. 17 illustrates a top view of the illumination sight shown in FIG. 15, mounted on a firearm, in accordance with various embodiments.
Figure 18:
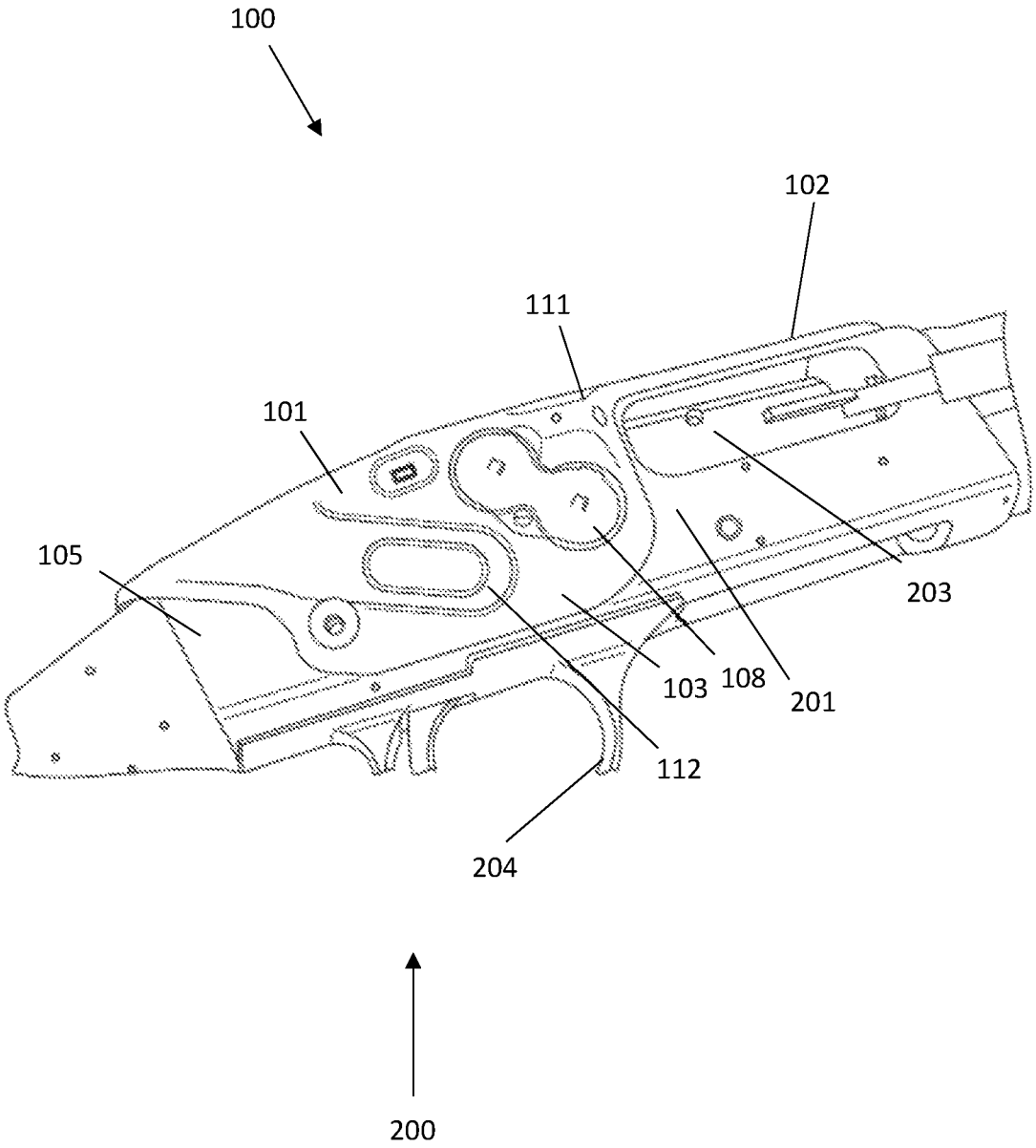
FIG. 18 illustrates a bottom rear perspective view of the illumination sight shown in FIG. 15, mounted on a non-shoulderable firearm, in accordance with various embodiments.
Figure 19:
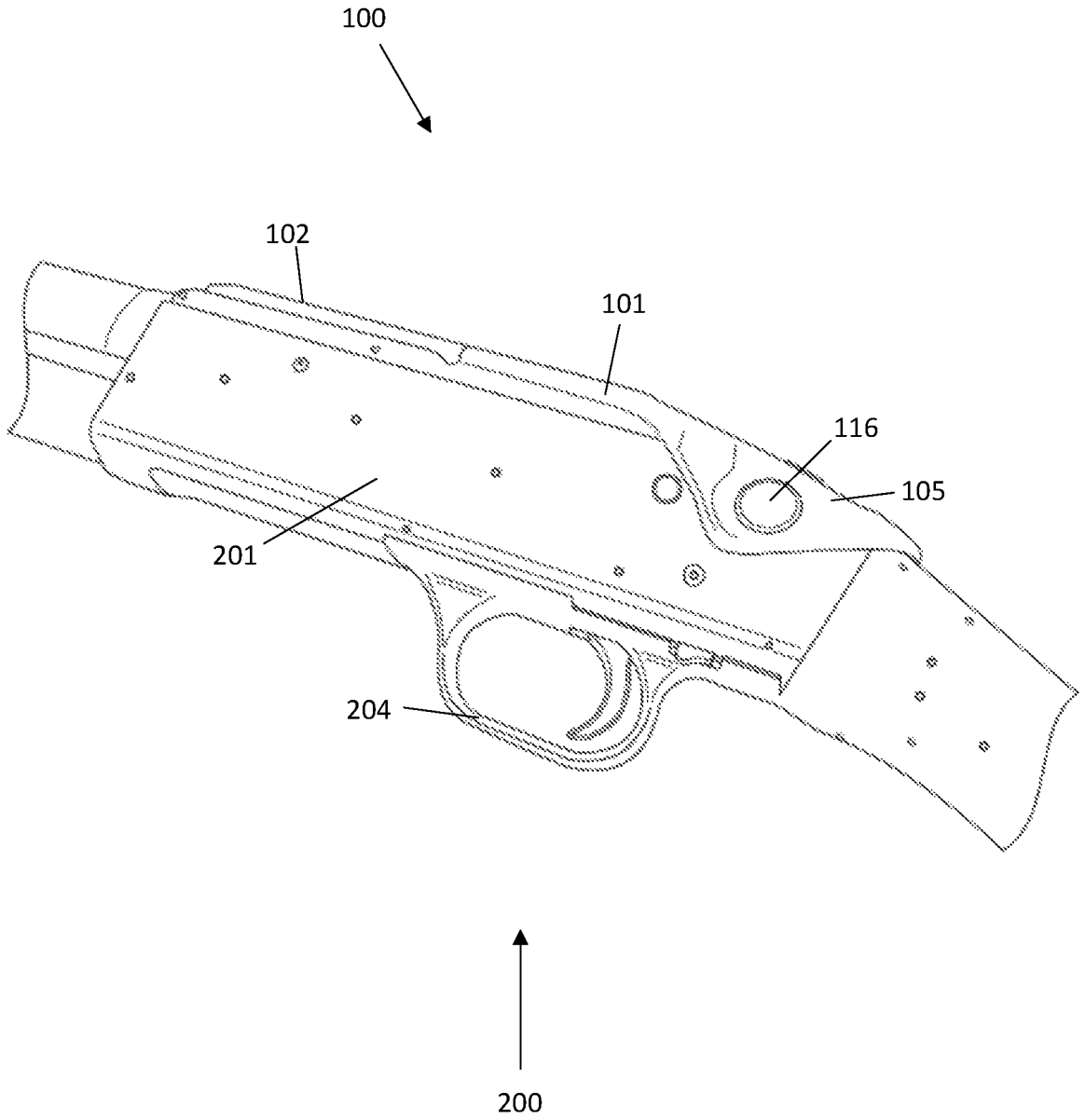
FIG. 19 illustrates a bottom rear perspective view of the illumination sight shown in FIG. 15, mounted on a non-shoulderable firearm, in accordance with various embodiments.

Referring now to FIGS. 1-9, the laser sight 100 includes a housing member 101 that is shaped to fit closely against an outside surface of a receiver portion of a firearm, resulting in a low-profile exterior surface that minimizes the chance of snagging on objects or undesirably affecting the usability of the firearm. In the embodiments shown, the housing member 101 includes a front portion 102, that extends forward on the receiver towards the barrel of the firearm (see, for example, FIG. 11). The front portion 102 is configured to follow the contour of the receiver as it moves toward the front of the firearm, and may include one or more or more fastener holes 104 that align with one or more factory-provided fastener holes on the receiver, such that the front portion 102 of the housing member 101 can be coupled to the receiver with one or more screws or other fasteners. In embodiments, the front portion 102 of the housing 101 extends along the top of the receiver and above the ejection port of the firearm. By extending the front portion, the housing member 101 and hence the laser sight 100 is more easily aligned axially with the barrel of the firearm.

In the embodiments shown, the housing member 101 includes a rear portion 105 that extends rearward on the receiver towards the butt end of the firearm (see, for example, FIGS. 10-13). The rear portion 105 is configured to follow the contour of the receiver as it moves away from front of the firearm, sloping downward toward the butt end of the firearm, and may include one or more fastener holes 104 that align with one or more factory-provided fastener holes on the receiver, such that the rear portion 105 of the housing member 101 can be coupled to the receiver with one or more screws or other fasteners. In various embodiments, the housing member 101 also includes one or more apertures 106 in the rear portion 105 to accommodate a safety switch or other feature of the receiver (see, for example, FIG. 12).

The housing member 101 also includes a lower extension 103 that is configured to follow the side contour of the receiver as it extends from the top of the receiver toward the bottom of the receiver, e.g., toward the trigger or trigger guard. The lower extension 103 may include one or more gripping elements to allow the housing member 101 to grip and couple to the receiver. The lower extension 103 further includes the housing 111 for the laser 110. The lower extension 103 may also include a battery receptacle 108 for housing one or more batteries to power the laser sight 110. In various embodiments, the housing member 101 also include a laser module 110 near the front portion of the laser sight 100. In various embodiments, the laser module 110 includes a laser diode that be aligned to project a beam that is substantially parallel to the barrel, and that intersects at a desired distance with the trajectory of a projectile (such as a bullet) fired from the firearm. In some embodiments, the laser sight 100 be factory calibrated, and in other embodiments, the laser sight includes windage and elevation screws to allow user calibration of the laser beam with respect to a target.

In various embodiments, the laser sight 100 also includes one or more activation elements 112. In some embodiments, an activation element or pair of elements be provided so that the user activates the laser sight 100 with either hand without altering their grip on the firearm (e.g., the activation buttons, switches, pressure activation elements, and/or sensory technology elements be suitable for ambidextrous activation). The disclosed laser sight 100 may also include a master switch for powering the device on or off. In various embodiments, the laser sight 100 couple to the receiver in such a way as to provide a smooth, integrated-appearing profile.

Figure 10:
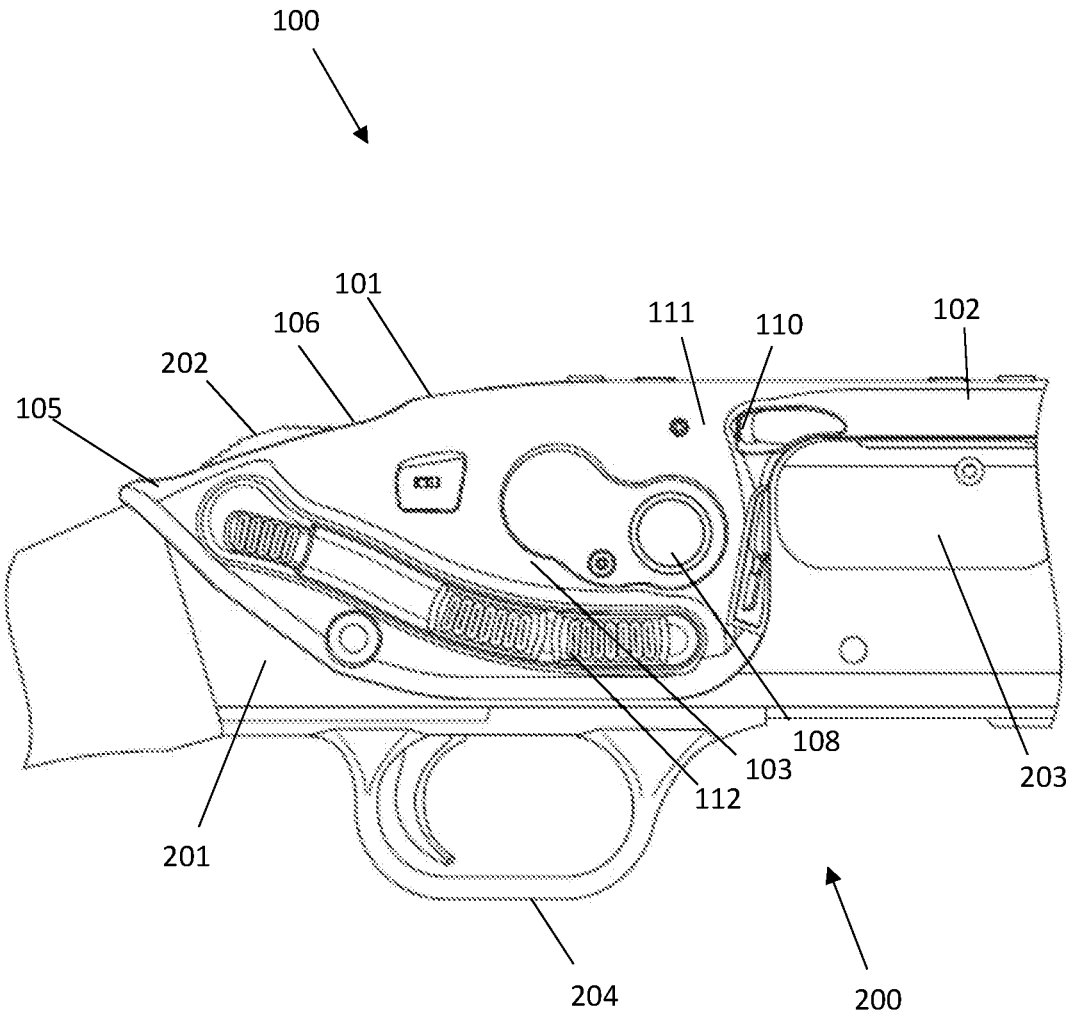
FIG. 10 illustrates a side elevation view of the illumination sight shown in FIG. 1, mounted on a non-shoulderable firearm, in accordance with various embodiments.

Turing now to FIGS. 10-14, the laser sight 100 as discussed above is shown in relation to the installation on a receiver 201 of a non-shoulderable shotgun 200. With reference to FIG. 10, the housing member 101 is shaped to fit closely against an outside surface of a receiver portion 201 of a shotgun 200. The laser sight 100 is mounted to the receiver portion 201 of a shotgun 200 without the need of a rail and or adaptor. The laser sight 100 does not protrude more than ½ inch from the existing surfaces of the shotgun 200 and is free of protruding edges that would prevent it from sliding in a scabbard. The resulting configuration results in a low-profile exterior surface that minimizes the chance of snagging on objects or undesirably affecting the usability of the firearm. The laser sight 100 is configure to allow for mounting of a Picatinny rail on top of the laser sight 100 and/or the barrel of the shotgun 200.

In the embodiments shown, the housing member 101 includes a front portion 102 that extends forward on the receiver towards the barrel of the shotgun 200. The front portion 102 is configured to follow the contour of the receiver 201 as it moves toward the front of the shotgun 200, and may include one or more or more fastener holes 104 that align with one or more factory-provided fastener holes on the receiver 201, such that the front portion 102 of the housing member 101 can be coupled to the receiver 201 with one or more screws or other fasteners. In embodiments, the front portion 102 of the housing 101 extends along the top of the receiver and above the ejection port 203 of the shotgun 200. By extending the front portion 102, the housing member 101 and hence the laser sight 100 is more easily aligned axially with the barrel of the shotgun 200.

In the embodiments shown, the housing member 101 includes a rear portion 105 that extends rearward on the receiver 201 towards the butt end of the shotgun 200. The rear portion 105 is configured to follow the contour of the receiver 201 as it moves toward away from front of the firearm, sloping downward toward the butt end of the shotgun 200, and may include one or more or more fastener holes 104 that align with one or more factory-provided fastener holes on the receiver 201, such that the rear portion 105 of the housing member 101 can be coupled to the receiver 201 with one or more screws or other fasteners. In various embodiments, the housing member 101 also includes one or more apertures 106 in the rear portion 105 to accommodate a safety switch 202 or other feature of the receiver 201.

The housing member 101 also includes a lower extension 103 that is configured to follow the side contour of the receiver 201 as it extends from the top of the receiver 201 toward the bottom of the receiver, e.g. toward the trigger or trigger guard 204. The lower extension 103 may include one or more gripping elements to allow the housing member 101 to grip and couple to the receiver 201. The lower extension 103 further includes the housing 111 for the laser 110. The lower extension 103 may also include a battery receptacle 108 for housing one or more batteries to power the laser sight 110. In various embodiments, the housing member 101 also include a laser module 110 near the front portion of the laser sight 100. In various embodiments, the laser module 110 include a laser diode that be aligned to project a beam that is substantially parallel to the barrel, and that intersects at a desired distance with the trajectory of a projectile (such as a bullet) fired from the firearm. In some embodiments, the laser sight 100 produce a laser beam that produces a larger diameter laser sighting 'dot' compared to conventional laser sights for other types of firearms, such as a "dot" having a diameter of about two inches or greater at a distance of 1 meter. In use, the laser module projects a laser beam onto a target to indicate the position where a projectile will land on the target when the firearm is actuated. In some embodiments, the laser sight 100 be factory calibrated, and in other embodiments, the laser sight include windage and elevation screws to allow user calibration of the laser beam with respect to a target.

In various embodiments, the laser sight 100 also include one or more activation elements 112, such as the switches depicted in the illustrated embodiment. In some embodiments, an activation element or pair of elements be provided so that the user activate the laser sight 100 with either hand without altering their grip on the firearm (e.g., the activation buttons, switches, pressure activation elements, and/or sensory technology elements be suitable for ambidextrous activation). In some embodiments, being able to activate the device without altering grip be desirable, particularly because non-shoulderable firearms require skilled handling in order to manage recoil. The disclosed laser sight 100 may also include a master switch for powering the device on or off. In various embodiments, the laser sight 100 couple to the receiver in such a way as to provide a smooth, integrated-appearing profile.

Referring now to FIGS. 15-19, an alternate embodiment is shown. As shown in FIGS. 15-19, the laser sight 100 includes a housing member 101 that is shaped to fit closely against an outside surface of the receiver, resulting in a low-profile exterior surface that minimizes the chance of snagging on objects or undesirably affecting the usability of the firearm. In some embodiments, the housing member 101 includes a lower surface that includes one or more gripping elements to allow the housing member 101 to grip and couple to the receiver. In some embodiments, the housing member 101 also includes one or more fastener holes 104 that align with one or more factory-provided fastener holes on the receiver, such that the housing member 101 be coupled to the receiver with one or more screws or other fasteners.

In various embodiments, the housing member 101 also include one or more apertures 106 to accommodate a safety switch or other feature of the receiver, and a battery receptacle 108 for housing one or more batteries to power the laser sight 100. In various embodiments, the housing member 101 also include a laser module 110 near the front portion of the laser sight 100. In various embodiments, the laser module 110 include a laser diode that be aligned to project a beam that is substantially parallel to the barrel, and that intersects at a desired distance with the trajectory of a projectile fired from the firearm.

In various embodiments, the laser sight 100 also include one or more activation elements 112, such as the pair of depressable switches depicted in the illustrated embodiment. In some embodiments, an activation element or pair of elements be provided so that the user activate the laser sight 100 with either hand without altering their grip on the firearm (e.g., the activation buttons, switches, pressure activation elements, and/or sensory technology elements be suitable for ambidextrous activation). In some embodiments, being able to activate the device without altering grip be desirable, particularly because non-shoulderable shotguns require skilled handling in order to manage recoil. The disclosed laser sights 100 also include a master switch for powering the device on or off.

Although certain embodiments have been illustrated and described herein, it will be appreciated by those of ordinary skill in the art that a wide variety of alternate and/or equivalent embodiments or implementations calculated to achieve the same purposes be substituted for the embodiments shown and described without departing from the scope. Those with skill in the art will readily appreciate that embodiments be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A system, comprising:

a firearm comprising a receiver; and an illumination sight, comprising:

a housing member that is configured to be placed over a receiver of a firearm, the housing couples to a top surface of the receiver, the housing member including a lower extension that extends down the side of the receiver toward a trigger of the firearm when installed;

an attachment pin configured to couple the lower extension to the receiver; the attachment pin replaces a trigger housing pin of the firearm when installed;

a light source disposed within the housing member; and a power source disposed within the housing member that is configured to power the light source.

2. The system of claim 1, wherein the housing member comprises a rear portion that extends toward the butt end of the firearm.

3. The illumination sight of claim 1, wherein the housing member comprises a front portion that extends toward a barrel end of the firearm.

4. The system of claim 1, further comprising one or more fasteners that secure the illumination sight to the firearm when installed.

5. The system of claim 1, wherein the housing member protrudes less than ½ inch from the existing surfaces of the firearm when installed.

6. The system of claim 1, wherein the illumination sight is configured to mount a Picatinny rail.

7. The system of claim 1, further comprising an adjustment tool stored within the housing member, the adjustment tool is configured to adjust the sight and a battery compartment fastener.

8. The system of claim 1, wherein the light source comprises a visible light laser diode, an infrared laser diode, an LED, an infrared light source, or a combination thereof.

9. The system of claim 1, wherein the housing member further comprises an activation switch operably connected to the illumination source.

10. The system of claim 9, wherein the activation switch is positioned within 4 inches of a trigger of the firearm when installed on the firearm.

11. The system of claim 1, wherein the firearm is a non-shoulderable shotgun.

12. An illumination sight for a firearm, comprising: a housing member that is configured to be placed over a receiver of a firearm, the housing couples to a top surface of the receiver of a firearm, the housing member including a lower extension that extends down the side of the receiver toward a trigger of the firearm when installed;

an attachment pin configured to couple the lower extension to the receiver; the attachment pin replaces a trigger housing pin of the firearm when installed;

a light source disposed within the housing member; and a power source disposed within the housing member that is configured to power the light source.

13. The illumination sight of claim 12, wherein the housing member comprises a front portion that extends toward a barrel end of the firearm when installed.

14. The illumination sight of claim 12, wherein the housing member comprises a rear portion that extends toward the butt end of the firearm when installed.

15. The illumination sight of claim 12, further comprising one or more fasteners that secure the illumination sight to the firearm when installed.

16. The illumination sight of claim 12, wherein the housing member protrudes less than ½ inch from the existing surfaces of the weapon when installed.

17. The system of claim 12, wherein the illumination sight is configured to mount a Picatinny rail.

18. The system of claim 12, further comprising an adjustment tool stored within the housing member, the adjustment tool is configured to adjust the sight and a battery compartment fastener.

19. The illumination sight of claim 12, wherein the light source comprises a visible light laser diode, an infrared laser diode, an LED, an infrared light source, or a combination thereof.

20. The illumination sight of claim 12, wherein the housing member further comprises an activation switch operably connected to the illumination sight.

21. The illumination sight of claim 12, wherein the firearm is a non-shoulderable shotgun.

22. A firearm comprising the illumination sight of claim 12.

23. The firearm of claim 22, wherein the firearm is a shotgun having a pistol grip.

* * * * *